US006156090A

United States Patent [19]

Ishikawa et al.

[11] Patent Number: 6,156,090

[45] Date of Patent: Dec. 5, 2000

[54] AIR CLEANER HAVING VANES WITH A WINGLIKE CROSS-SECTION BETWEEN A SHROUD AND BASEPLATE FOR ROTATION WITHIN A HOUSING

[75] Inventors: Tominori Ishikawa; Yuji Toyama, both of Niigata-ken; Makoto Yokoyama, Toyosaka; Yoshihiro Takada, Ibaraki-ken; Keiichi Honma, Niigata-ken; Osamu Kawasaki, Niigata-ken; Masayosi Inoue, Niigata-ken; Kazunari Sugai, Niigata-ken; Jun Tazawa, Niigata-ken, all of Japan

[73] Assignees: Hitachi, Ltd.; Hitachi Techno Engineering Co., Ltd., both of Tokyo, Japan

[21] Appl. No.: 09/164,582

[22] Filed: Oct. 1, 1998

[30] Foreign Application Priority Data

Oct. 3, 1997 [JP] Japan ..... 9-270794
Mar. 25, 1998 [JP] Japan ..... 10-076952

[51] Int. Cl.[7] ..... B01D 35/30; F01D 5/22

[52] U.S. Cl. ..... 55/471; 55/473; 416/178; 416/187; 416/146 R; 416/144; 416/190; 416/243

[58] Field of Search ..... 55/385.2, 418, 55/467, 471, 473, 490, 495, 472; 454/187; 416/178, 187, 144, 145, 146 R, 190, 243

[56] References Cited

U.S. PATENT DOCUMENTS 2,676,057 4/1954 Daugherty ..... 416/146 R
3,536,416 10/1970 Glucksman ..... 416/178
4,165,950 8/1979 Wasai et al. ..... 416/178
5,053,065 10/1991 Garay et al. ..... 55/385.2
5,476,365 12/1995 Kobayashi ..... 416/178
5,586,053 12/1996 Park ..... 416/178
5,876,279 3/1999 Renz et al. ..... 454/187

OTHER PUBLICATIONS

Japanese Patent Unexamined Publication No. 9–210418 date Aug. 12, 1997.

Japanese Patent Unexamined Publication No. 57–35198 date: Feb. 25, 1982.

Cbm Industries, Inc., "Motorized Impellers for 2×4 ceiling mounted HEPA Filter Clean room Modules", pp. 1 & 2, 1987.

*Primary Examiner*—David A. Simmons
*Assistant Examiner*—Robert A. Hopkins
*Attorney, Agent, or Firm*—Antonelli, Terry, Stout & Kraus, LLP

[57] ABSTRACT

An air cleaner includes a housing having an upper wall and side walls, an air filter mounted with respect to the housing, a fan including a vane-wheel having a plurality of vanes, a supporting plate extending substantially between at least two side walls for supporting the fan. An air flow directional member directs an air flow output from the fan. The vane is formed to have a winglike cross-section, and the vane-wheel includes not more than four vanes. The vane-wheel has a base plate and a shroud. Each of the base plate and the shroud is formed to have a reinforcement portion on its circumference. A U-shaped balance weight is attached to a flattened portion formed on the curled portion. The air cleaner of the present invention can reduce noise and vibration and improve efficiency of the fan.

37 Claims, 13 Drawing Sheets

AIR CLEANER HAVING VANES WITH A WINGLIKE CROSS-SECTION BETWEEN A SHROUD AND BASEPLATE FOR ROTATION WITHIN A HOUSING

BACKGROUND OF THE INVENTION

1. Technical Field of the Invention

The present invention generally relates to an air cleaner, and more specifically, relates to an air cleaner installed within a ceiling of a clean room used for manufacturing elements or devices such as semiconductor or liquid crystal arrangements, wherein the air cleaner has a vane-wheel capable of improving a fan efficiency and capable of decreasing a noise and a vibration.

2. Description of Related Art

An example of a construction of an air cleaner in a related art is explained referring to FIGS. 20–22. As is disclosed in FIG. 20, the air cleaner 20 in the related art has a fan including a vane-wheel 10 and a motor 6 for rotating the vane-wheel 10, a filter 24 and a housing 21 for accommodating the fan and the filter 24. A motor base 7 supports the motor 6 in the housing 21. The housing 21 has an air inlet 26 at its upper plate, and has an opening at its bottom portion for installing the filter 24. A filter frame 28 is disposed so as to surround the outer periphery of the filter 24. The frame 28 has a gasket 29 at its bottom. A pressurizing chamber 22 is formed inside the housing 21 in an upper stream side of the filter 24.

The vane-wheel 10 is directly connected to a rotational shaft of the motor 6 through a boss 5, and is driven rotatively by the motor 6 so as to take in air from the air inlet 26. When the vane-wheel 10 rotates, the air from the air inlet 26 is sucked through a sucking port 10*a* of the vane-wheel 10 and is blown out from a blowing port 10*b* of the vane-wheel 10. The air blown out from the blowing port 10*b* is supplied to the pressurizing chamber 22 for increasing a static pressure thereof and is then supplied to the filter 24. The filter 24 purifies the air by removing such small particles having diameters as small as 0.1 micrometers. At the air inlet 26, a bell mouth 26*a* is provided on the opposite side of the sucking port 10*a* in order to smooth a flow of the air which is sucked.

As disclosed in FIGS. 21 and 22, the vane-wheel has a base plate 2, a shroud 1, and a plurality of vanes 3. Each vane 3 is made of metal sheet such as alminium or stainless steel and is formed to have a curved surface. The vane 3 has a shape of a simple curved plate or complicated three-dimensional shape. The vane 3 has a plurality of tongues 3*a* at both sides facing respectively to the shroud 1 and the base plate 2. The shroud 1 and the base plate 2 have slots 1*d* and 2*b*, respectively, where the tongues 3*a* are inserted and secured. The shroud 1 has recessed portions 1*c*, where one side of each vane facing to the shroud 1 is engaged.

A problem in the related art is deterioration of the fan efficiency and increase of noise. More particularly, since each vane 3 is formed into a plate with a curved surface, a front end (an end facing to the sucking port 10*a*) 3*f* of the vane 3 has an edge. When the fan rotates, the edge induces turbulence of air, which results in increase of noise and pressure loss, and thereby an efficiency of the fan is deteriorated.

Another problem in the related art is increase of pressure loss along the surface of the vanes. That is, since the air cleaner in the related art is designed to obtain required air pressure by increasing the numbers of vanes, an area where an air flow that flows through the vane-wheel contacts the surfaces of the vanes increases. This increases friction between the air and the surfaces of the vanes, which results in increase of pressure loss along the surface of the vanes.

A further problem in the related art is occurrence of undesirable vibration or noise due to imbalance of the vane-wheel. More specifically, in the related art, the base plate 2 of the vane-wheel 10 has a flat portion 2*a* extending to its outer periphery. The shroud 1 of the vane-wheel 10 also has a flat portion at its outer periphery 1*a*. In order to prevent undesirable vibration or noise, a U-shaped balance weight 70 is attached at least to either one of the flat portions of the base plate 2 or the shroud 1. The balance weight 70 has arms 70*a* forming parallel sides of the U-shape, and the balance weight 70 squeezes the outer periphery of the base plate 2 or the shroud 1 with arms 70*a*. The balance weight 70 is fixed just by elastic forces of the arms 70*a* or just by a friction between the arm 70*a* and the surface of the base plate 2, or that between the arm 70*a* and the surface of the shroud 1. Such minimal securing approach allows displacement of the balance weight 70 by an unexpected external force in tangential direction at the time of handling the vane-wheel 10, eventually resulting in occurrence of undesirable vibration or noise due to imbalance.

Further related art is also disclosed in Japanese Patent Application Laid-open Nos. Hei-09-210418 and Sho-57-35198.

SUMMARY OF THE INVENTION

It is therefore an object of the present invention to solve the problems of the related art explained above. In view of the objective of solving the problems explained above, the construction of the air cleaner of the present invention includes a housing having an upper wall and side walls, an air filter mounted with respect to the housing, a fan including a vane-wheel having a plurality of vanes, a supporting plate extending substantially between at least two side walls of the housing for supporting the fan, and at least one air flow directional member extending between the supporting plate and the upper wall, for directing an air flow output from the fan, wherein the vane is formed to have a winglike cross-section, and the vane-wheel includes not more than four vanes.

In another embodiment, the air cleaner includes a housing having an upper wall and side walls, an air filter mounted with respect to the housing, a fan including a vane-wheel having a plurality of vanes, a supporting plate extending substantially between at least two side walls of the housing for supporting the fan, and at least one air flow directional member extending between the supporting plate and the upper wall for directing an air flow output from the fan, wherein the vane-wheel has a base plate and a shroud, each of the base plate and the shroud is formed to have a circular circumference, and wherein either one of the base plate and the shroud has a reinforcement portion at the circumference thereof.

In a third embodiment, the vane-wheel has a base plate and a shroud, wherein each of the base plate and the shroud is formed to have a circular circumference, either one of the base plate and the shroud has a reinforcement portion at the circumference thereof, the reinforcement portion has a curled portion, and the curled portion has a flattened portion where a U-shaped balance weight is attached.

In a fourth embodiment, the air cleaner includes a housing having an upper wall and side walls, a fan including a vane-wheel having a base plate, a shroud, a plurality of vanes and a motor for rotating the vane-wheel, a supporting plate extending substantially between at least two side walls of the housing for supporting the fan, and at least one air flow directional member extending between the supporting plate and the upper wall for directing an air flow output from the fan. An air filter is mounted with respect to the housing for purifying air supplied from the fan, wherein the vane is formed to have a winglike cross-section, and the vane-wheel includes not more than four vanes. Each of the base plate and the shroud is formed to have a circular circumference, wherein at least either one of the base plate and the shroud has a reinforcement portion at the circumference thereof and power consumption of the motor is within a range of 36–44 W when an air flow volume output from the air filter is within a range of 11.7–14.3 cubic meter/min.

As explained above, since not more than four vanes are provided in a vane-wheel, friction between the vane and air flow is reduced, which enables efficiency of the fan and reduces energy loss.

In addition, since a reinforcement portion is disposed on a circular circumference of the base plate and the shroud, vibration of the base plate and the shroud is suppressed by increase of their stiffness. Further, by forming a curled portion at the circumference, a U-shaped balance weight can be attached firmly by forming a flattened portion. Since displacement of the attached balance weight from its suitable position is prevented, occurrence of noise and vibration caused by imbalance is prevented.

BRIEF DESCRIPTION OF THE DRAWINGS

The foregoing and a better understanding of the present invention will become apparent from the following detailed description of exemplary embodiments and the claims when read in connection with the accompanying drawings, all forming a part of the disclosure hereof this invention. While the foregoing and following written and illustrated disclosure focuses on disclosing exemplary embodiments of the invention, it should be clearly understood that the same is by way of illustration and example only and is not to be taken by way of limitation, the spirit and the scope of the present invention being limited only by the terms of the appended claims.

The following represents brief descriptions of the drawings, wherein.

DETAILED DESCRIPTION OF THE INVENTION

Figure 1:
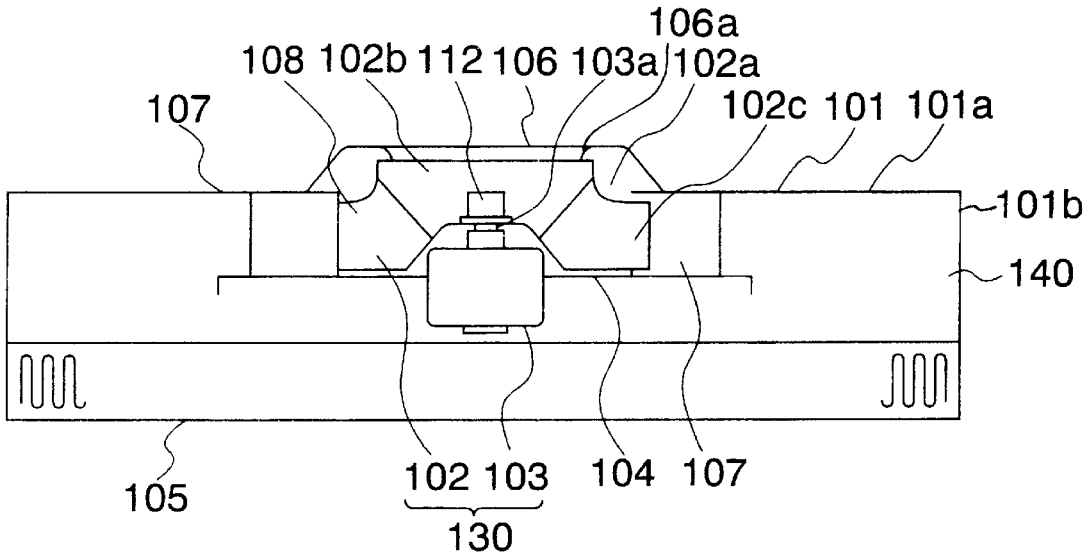
FIG. 1 shows a cross-sectional elevational view of an air cleaner in one embodiment of the present invention.

Before beginning a detailed description of the subject invention, mention of the following is in order. When appropriate, like reference numerals and characters are used to designate identical, corresponding or similar components in differing figure drawings. Further, in the detailed description to follow, exemplary sizes/models/values/ranges are given, although the present invention is not limited to th esame.

Exemplary embodiments of the present invention will now be explained with reference to FIGS. 1 to 19. As disclosed in FIGS. 1 and 2, an air cleaner in this embodiment has a fan 130, a filter 105 and a housing 101 for accommodating the fan 130 and the filter 105. The fan 130 includes a vane-wheel 102, and a motor 103 to rotate the vane-wheel 102. A motor base 104, configured as a supporting plate, supports the motor 103 in the housing 101. The housing 101 has an upper wall 101*a*, side walls 101*b* and an opening at its bottom portion for installing the filter 105. The housing 101 has an air inlet 106 formed at its upper wall 101*a*. A pressurizing chamber 140 is formed at the upper stream side of the filter 105 within the housing 101.

The vane-wheel 102 is directly connected to a rotational shaft 103*a* of the motor 103, and is driven to rotate by the motor 103 so as to take in air from the air inlet 106. When the vane-wheel 102 rotates, the air from the air inlet 106 is sucked through a sucking port 102*b* of the vane-wheel 102 and is blown out from a blowing port 102*c* of the vane-wheel 102. An air flow from the fan 130 is introduced into a fan area defined between the motor base 104 and the upper wall

101*a*. The air is supplied to the pressurizing chamber 140 via the fan area for increasing a static pressure thereof and is then supplied to the filter 105. The filter 105 purifies the air by removing small particles such as having diameters as small as 0.1 micrometers. Usually, an ULPA (Ultra Low Penetration Air) filter or a HEPA (High Efficiency Particulate Air) filter is used as the filter 105 when a high cleanliness level is required. At the air inlet 106, a bell mouth 106*a* is provided facing the sucking port 102*b* in order to smooth a flow of the air to be sucked.

Figure 2:
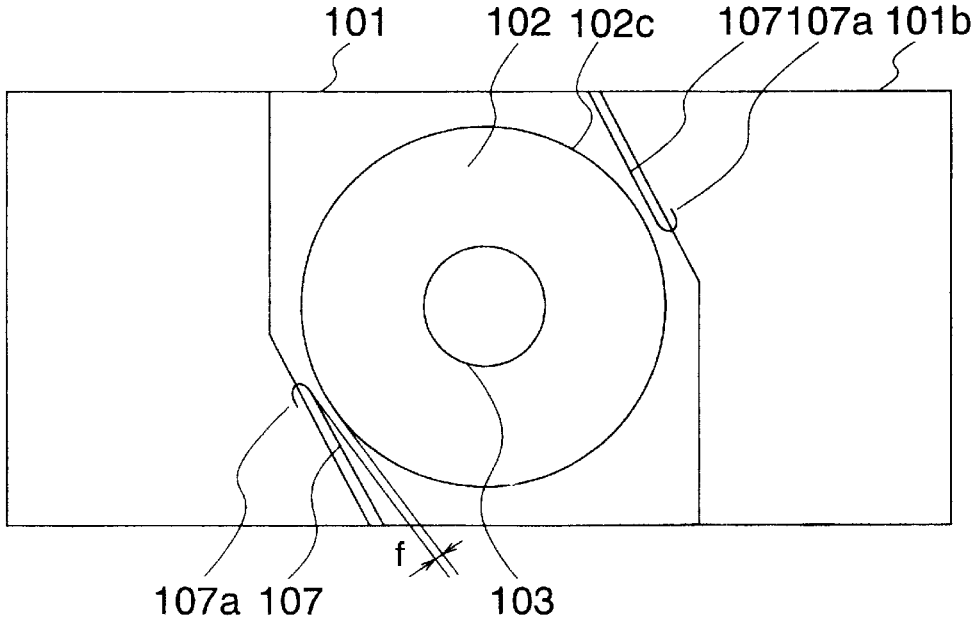
FIG. 2 shows a cross-sectional plan view of the air cleaner in one embodiment of the present invention.

The air cleaner in this embodiment also has guide plates 107, acting as air flow directional members, and being provided vertically between the upper wall 101*a* and the motor base 104. The guide plates 107 also connect the motor base 104 and the upper wall 101*a* so as to provide rigid reinforcement to the housing 101. In one preferred configuration, the motor base 104 has a hexagonal shape, and a pair of guide plates 107 are disposed in diagonal positions with one end being connected to the side wall. The other end 107*a* of the guide plate 107 is disposed to be spaced a predetermined distance f from an outer periphery of the vane-wheel 102 and has a curl so as to guide an air flow from the vane-wheel smoothly without inducing a turbulent flow as shown in FIG. 2. This distance f is determined in relation to a desired characteristic of the fan 130, as described in Japanese patent application No. Hei-09-164259. In addition, the curl of the guide plate 107 guides the air blown out from the vane-wheel 102 so as to difuse the same within the pressurising chamber 140, which converts dynamic pressure into static pressure around the outer periphery of the vane-wheel 102. Thus, air flow volume blown out from the filter 105 increases by the increase of static pressure within the pressurising chamber 140.

Figure 3:
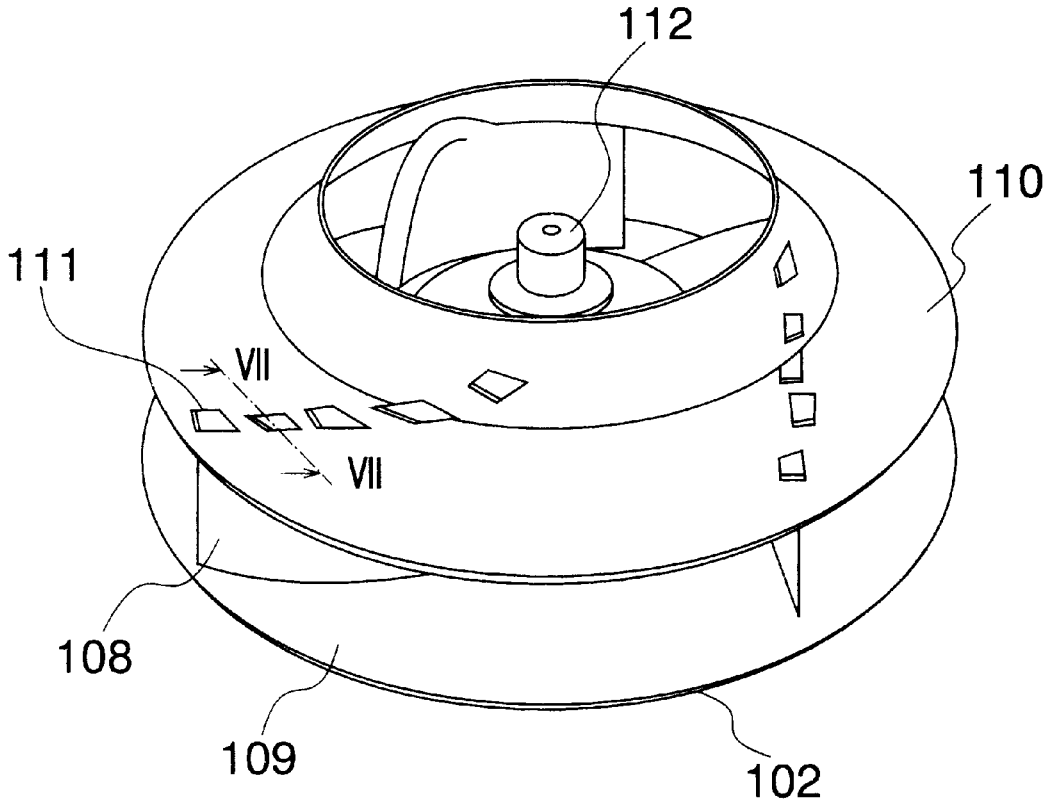
FIG. 3 shows a perspective view of a vane-wheel in one embodiment of the present invention.

A more detailed construction of the vane-wheel 102 is now explained referring to FIGS. 3–10 and FIG. 12. FIG. 3 shows a perspective view of the vane-wheel 102 of this embodiment. The vane-wheel 102 includes a shroud 110, a base plate 109, a plurality of vanes 108 and a boss 112. The shroud 110 is formed in a disc shape, and a sucking port 102*b* is formed at its center. The base plate 109 is also formed in a disc shape and has substantially the same diameter as the shroud 110. The vanes 108 are fixed between the shroud 110 and the base plate 109. Blowing ports 102*c* are formed between the shroud 110 and the base plate 109 and between the adjacent vanes 108. The boss 112 is fixed to the base plate 109 at its rotational center. In this embodiment, the vane 108 has a cross-section resembling to that of a wing of an airplane (hereinafter winglike cross-section). The vane-wheel 102 is designed to have not more than four vanes 108 in order to reduce a pressure loss between the sucking port 102*b* and the blowing port 102*c* by reducing surface area of the vanes 108 as a whole. Since surface area of air flow paths from the sucking port 102*b* to the blowing port 102*c* decreases totally, friction of the air flow paths decreases resulting in reduction of pressure loss within the vane-wheel 102. In this embodiment, three vanes 108 are disposed within the vane-wheel 102.

Figure 4:
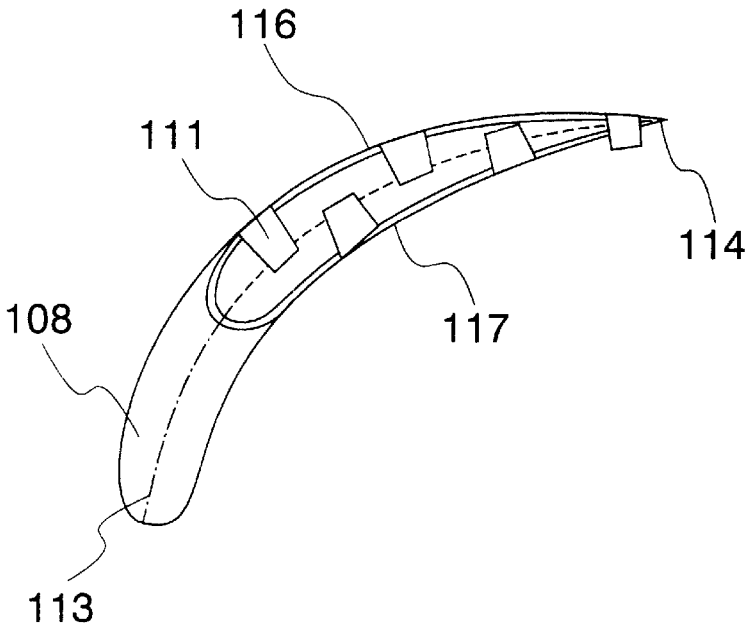
FIG. 4 shows a perspective view of a vane in one embodiment of the present invention.
Figure 5:
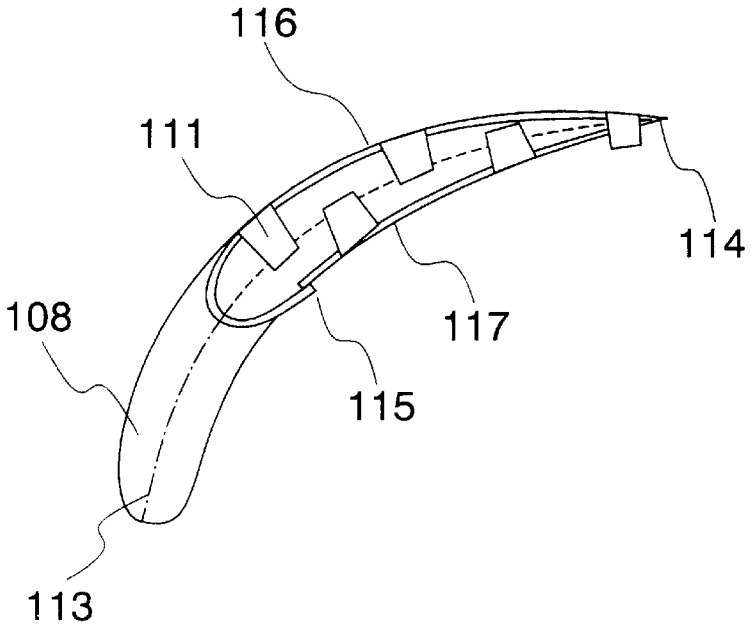
FIG. 5 shows a perspective view of a variation of the vane in one embodiment of the present invention.
Figure 6:
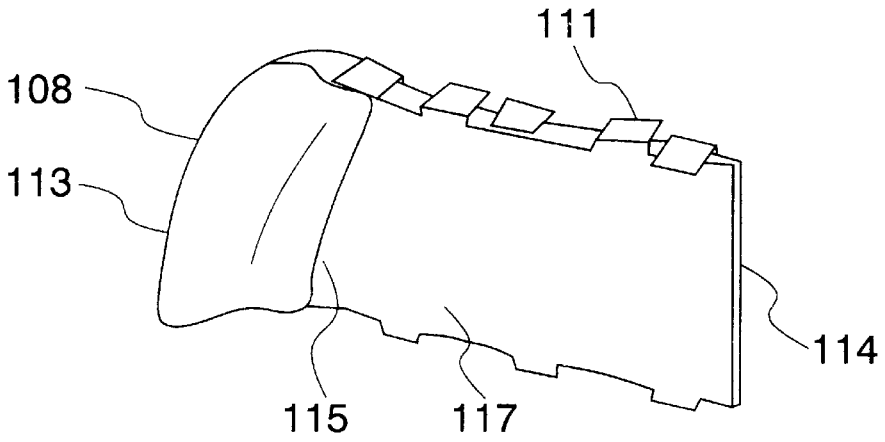
FIG. 6 shows a perspective view of the variation of the vane in one embodiment of the present invention.
Figure 7:
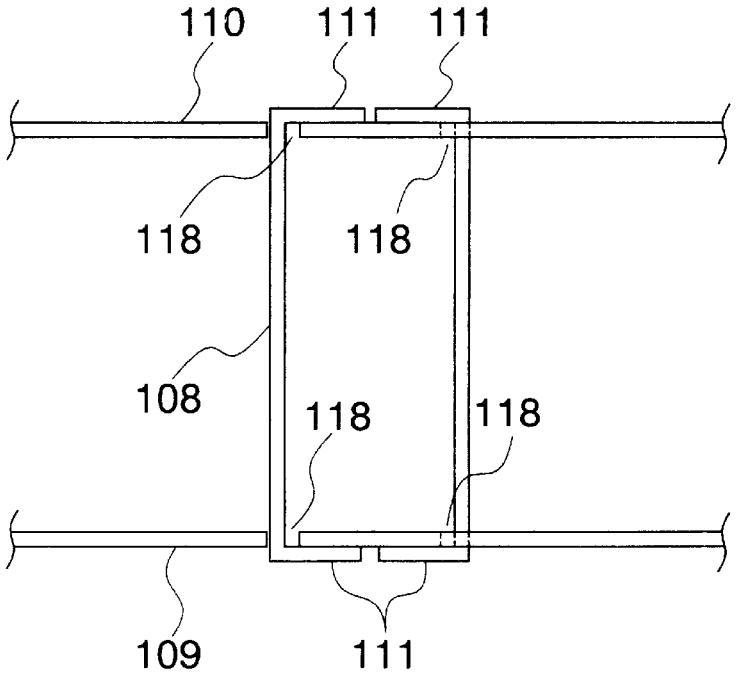
FIG. 7 shows a cross-sectional view of a vane fixed to a shroud and a base plate in one embodiment of the present invention.

Construction of the vane 108 is explained referring to FIGS. 4–7. As shown in FIG. 4, the vane 108 is formed by bending a thin metal sheet into a winglike cross-section. The vane 108 has a curved surface on both sides of a high-pressure side 116 and a low-pressure side 117 respectively. In this embodiment, the high-pressure side 116 has a protruding curved surface and the low-pressure side 117 has a recessed curved surface. A front end 113 of the vane 108 is formed to have a curved surface for smoothing entry of air sucked from the sucking port 102*b*. This prevents turbulent flow from being induced and enables to improve an efficiency of the fan and to reduce a noise of the fan. A rear end 114 of the vane 108 is formed to have a sharp edge by connecting both ends of the thin metal sheet. The rear end 114 is fixed by resistance welding. A plurality of tongues 111 are formed on the sides of the vane 108 facing to the shroud 110 and the base plate 109. A plurality of slots 118 are formed on the shroud 110 and the base plate 109. As shown in FIG. 7, the tongues 111 are inserted into these slots 118 and are bent for securing the vane 108 to the shroud 110 and the base plate 109. A cavity is formed within the vane 108 after secured to the shroud 110 and the base plate 109. FIG. 5 shows a condition when the tongues 111 are bent. Actually, before inserting the tongues 111 into the slots 118, the tongues 111 are formed to project from the sides of the vane 108.

A variation of the vane 108 is explained referring to FIGS. 5 and 6. In this variation, the vane 108 is composed of two pieces, i.e., a high-pressure side 116 and a low-pressure side 117 are made of thin metal sheet separately. The sheet of the high-pressure side 116 (hereinafter high-pressure side sheet 116) is formed to have a J-shape and the rounded end of the J-shape extends into the low-pressure side as disclosed in FIG. 5. The sheet of the low-pressure side 117 (hereinafter low-pressure side sheet 117) is formed to have a shape of slightly curved plate. As shown in FIGS. 5 and 6, one end of the low-pressure side sheet 117 is connected to the rounded end of the J-shaped high-pressure side sheet 116 and the other end of the low-pressure side sheet 117 is connected to the straight end of the J-shaped high-pressure side sheet 116. The vane 108 in this variation also have a winglike cross-section. Junction portion 115 i.e., connected portion of rounded end of the J-shaped high-pressure side sheet 116 and one end of the low-pressure side sheet 117, is positioned backward against a rotational direction of the vane-wheel 102, namely at a low-pressure side of the vane 108 when the vane-wheel rotates. In addition, the junction portion 115 is disposed at a distance not less than the maximum value of the thickness of the vane 108 from the front end 113. The junction portion is formed smooth so as to prevent separation of the air flow, and formed nearly in parallel with the front end 113 and oblique with the rear end 114. Similarly to the vane 108 disclosed in FIG. 5, the vane 108 in this variation has a plurality of tongues 111 formed on its sides, and has a sharp edge at its rear end 114 formed by connecting both ends of the high-pressure side sheet 116 and the low-pressure side sheet 117. Tongues 111 are also inserted into the slots 118 formed on the shroud 110 and the base plate 109, and bent to secure the vane 108 tightly. This enables reduction of loss caused by leak of air through narrow gaps between the vane 108 and the shroud 110 or the base plate 109, resulting in improvement of efficiency of the fan 130.

Figure 8:
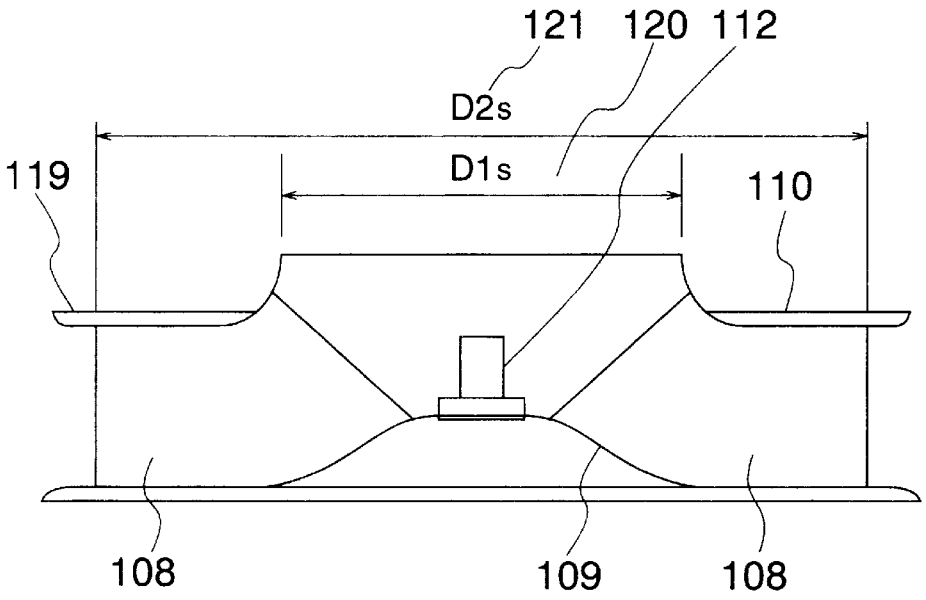
FIG. 8 shows a cross-sectional elevational view of the vane-wheel in one embodiment of the present invention.

The first variation of the vane-wheel 108 is explained referring to FIG. 8. In this variation, a reinforcement ring 119 as a reinforcement portion is formed at the outermost periphery of the shroud 110 and the base plate 109, respectively. As disclosed in FIG. 8, inner diameter D1s 120 is defined as a diameter of a circle determined by the innermost points where the front end of each vane 108 contacts the shroud 110, and the outer periphery diameter D2s 121 is defined as a diameter of the outer periphery of the vane-wheel, i.e., a circle determined by the outermost points where the rear end of each vane 108 is disposed. In this variation, a ratio of the inner diameter D1s to the outer periphery diameter D2s (i.e., D1s/D2s) is determined within a range of 0.59–0.76.

Figure 9:
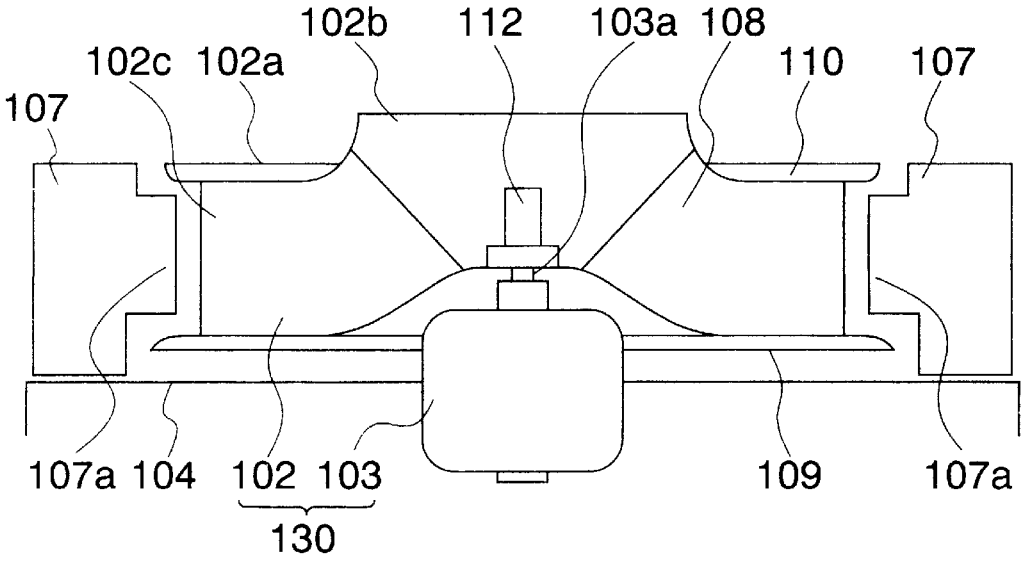
FIG. 9 shows a cross-sectional elevational view of the vane-wheel showing a positional relationship with a guideplate in one embodiment of the present invention.
Figure 10:
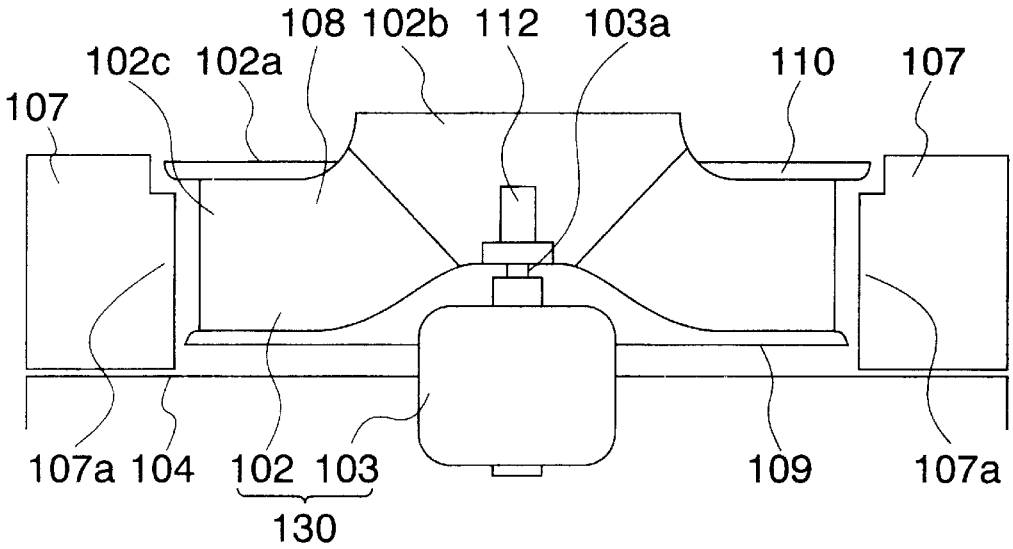
FIG. 10 shows a cross-sectional elevational view of the vane-wheel showing a variation of positional relationship with a guideplate in one embodiment of the present invention.
Figure 11:
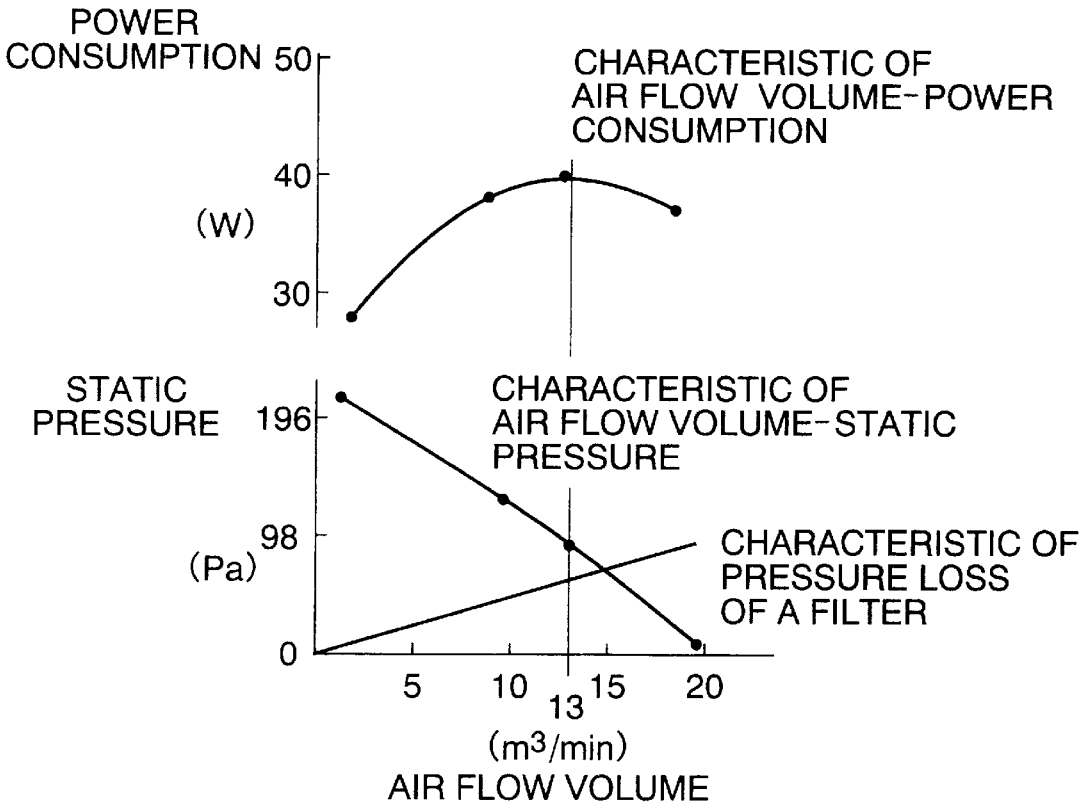
FIG. 11 shows power consumption static pressure and pressure loss characteristics in one embodiment of the present invention.

Variations of relationship between the vane-wheel 102 and the end 107*a* of the guide plate 107 are explained referring to FIGS. 9 and 10. In these variations, the end 107*a* of the guide plate is disposed near the outer periphery diameter D2s so as to increase the fan efficiency by reducing the distance f. An example of a relationship between the distance f and the fan efficiency is described in Japanese patent application No. Hei-09-164259. FIG. 9 shows an example of forming two notches on the guide plate 107, so that the end 107*a* can be placed close to the outer diameter D2s. FIG. 10 shows another example of forming one notch on the guide plate 107. This variation can be used when the diameter of the base plate 109 is similar to the outer periphery diameter D2s and also smaller than the diameter of the shroud 110.

Figure 12:
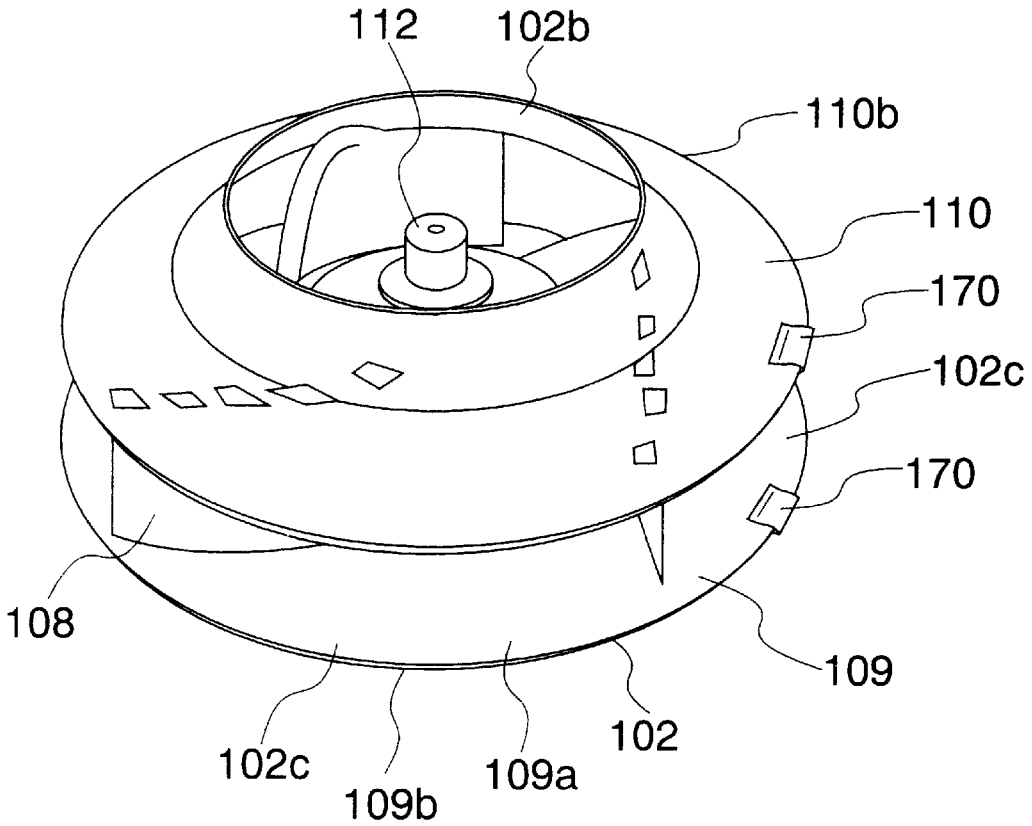
FIG. 12 shows a perspective view of the vane-wheel with balance weights in one embodiment of the present invention.
Figure 13:
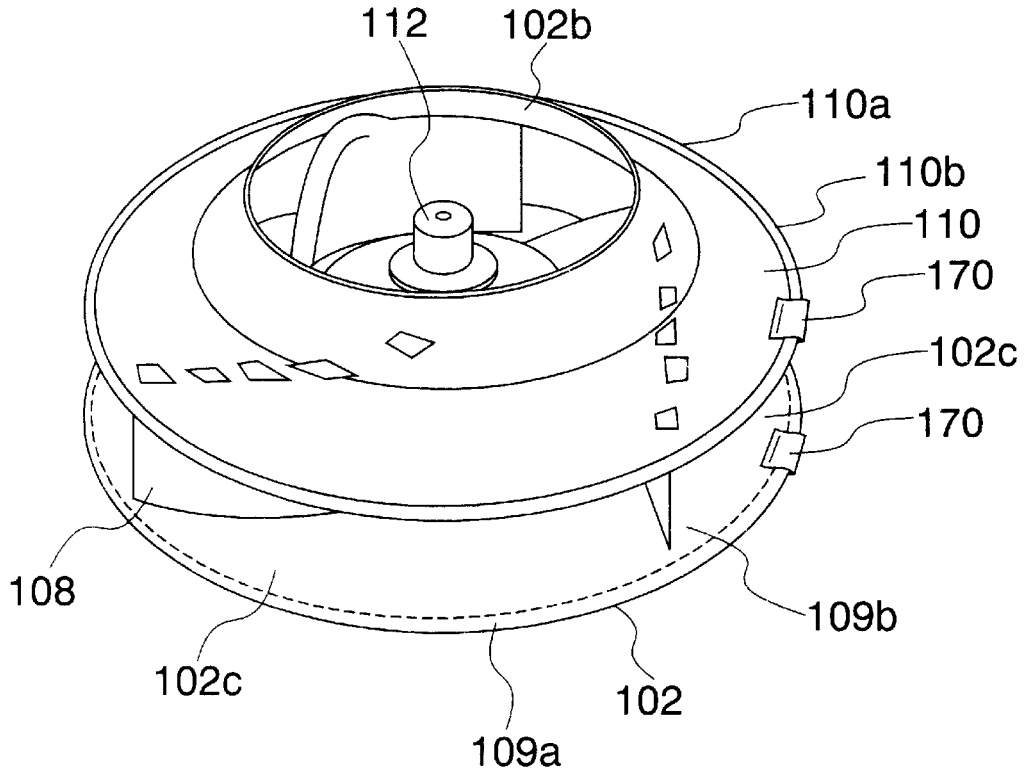
FIG. 13 shows a perspective view of the vane-wheel having a curled edge and with balance weights in one embodiment of the present invention.

As disclosed in FIG. 12, in order to reduce undesirable vibration or noise, a U-shaped balance weight 170 is attached at least to either one of the flat portions 109*b*, 10*b* of the base plate 109 or the shroud 110, respectively. The balance weight 170 has arms 170*a* (FIGS. 15–17) forming parallel sides of this U-shape, and the balance weight 170 squeezes the flat portions 109*b*, 110*b* with arms 170*a*. The balance weight 170 is fixed by elastic forces of the arms 170*a* and/or by a friction between the arm 170*a* and the surface of the flat portions 109*b* and 10*b*.

Figure 14:
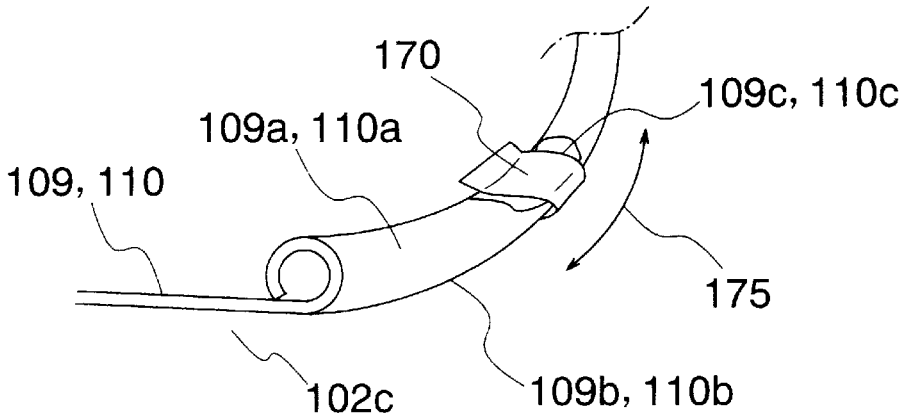
FIG. 14 shows a perspective view of the curled edge of the vane-wheel and the balance weights in one embodiment of the present invention.

The second variation of the vane-wheel is explained referring to FIGS. 13–19. In this variation, a reinforcement portion is formed at the outer periphery of the shroud 110 and the base plate 109, respectively. Each reinforcement portion is formed to have a curled portion 110*a*, 109*a* at the outer edge 109*b*, 110*b* of the base plate 109 and the shroud 110, respectively, and on the opposite side of air flow path from the sucking port 102*b* to the blowing port 102*c*. This smooths the air flow at the blowing port of the vane-wheel 102. In this variation, a portion of the curled portion 110*a*, 109*a* are deformed by plastic deformation, and flattened portions 109*c*, 110*c* are formed as shown in FIG. 14. The flattened portions 109*c*, 110*c* are generally formed by press working. The balance weight 170 is attached on at least one of these flattened portions 109*c*, 110*c*.

Figure 15:
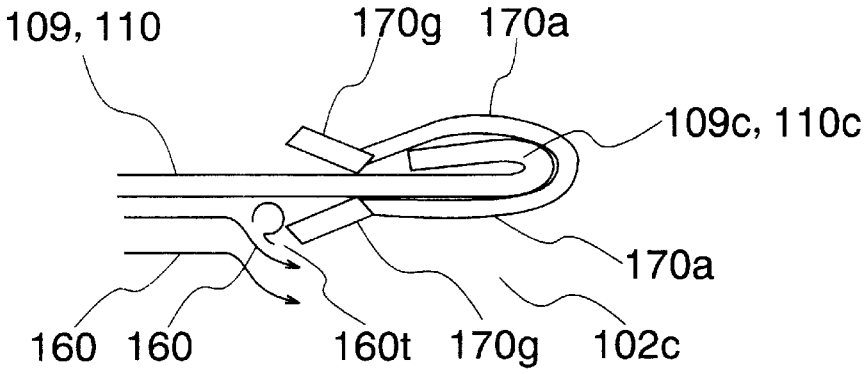
FIG. 15 shows a cross-sectional view of the curled edge of the vane-wheel and the balance weight in one embodiment of the present invention.

The balance weight 170 is formed to have a U-shape by bending a metal plate as shown in FIGS. 15–18. As shown in FIG. 15, the balance weight 170 has arms 170*a*, and a stopper 170*g* is formed at the end of each arm 170*a*.

The stopper 170*g* is locked by the flattened portion 109*c* or 110*c*. At first, the balance weight 170 is attached in such a manner that the stoppers 170*g* squeeze the flattened portion 109*c* or 110*c*. Next, the balance weight 170 is pushed inward to a portion where the stopper 170*g* travels elastically over the flattened portion 109*c* or 110*c*. Here the stopper 170*g* is locked by the flattened portion 109*c* or 110*c*, which prevents the balance weight 170 from moving outward, i.e., the direction of detaching the balance weight 170. Thus, the movement of the balance weight 170 in the radial direction is restricted. Further, since both sides rim portions before and after the flattened portion remains unflattened, the movement of the balance weight in the circumferential direction 175 or in the tangential direction is also restricted as disclosed in FIG. 14. Accordingly, an unexpected movement or undesirable movement of the balance weight by an external force can be In this variation, since the curled portion 109*a* or 110*a* is formed at all of the outer periphery of the base plate 109 or shroud 110 respectively, the flattened portion 109*c* or 110*c* can be disposed at any place of the circumference, and thus, accurate adjustment of the dynamic balance is attained. In addition, the curled position 109*a* or 110*a* reinforces the base plate 109 or shroud 110, respectively, and therefore occurrence of vibration and noise at the outer periphery 109*b* or 10*b* of the base plate 109 or shroud 110 is suppressed.

In the above variations, the reinforcement portions are formed on both the circular circumference of base plate 109 and the circular circumference of shroud 110. However, when either one of base plate 109 and shroud 110 does not have sufficient stiffness to prevent vibration, the reinforcement portion is formed at a weaker one or both of base plate 109 or shroud 110. Thus, the reinforcement portion is formed at least on either one of base plate 109 and shroud 110, when reinforcement is required.

Figure 16:
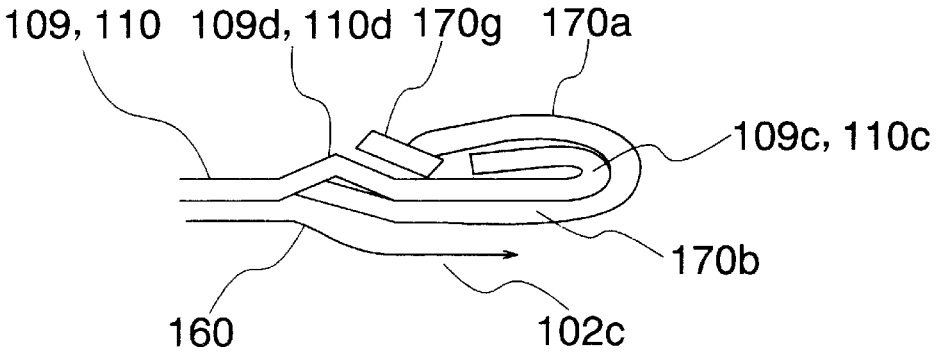
FIG. 16 shows cross-sectional view of the curled edge of the vane-wheel and the first variation of the balance weight in one embodiment of the present invention.
Figure 17:
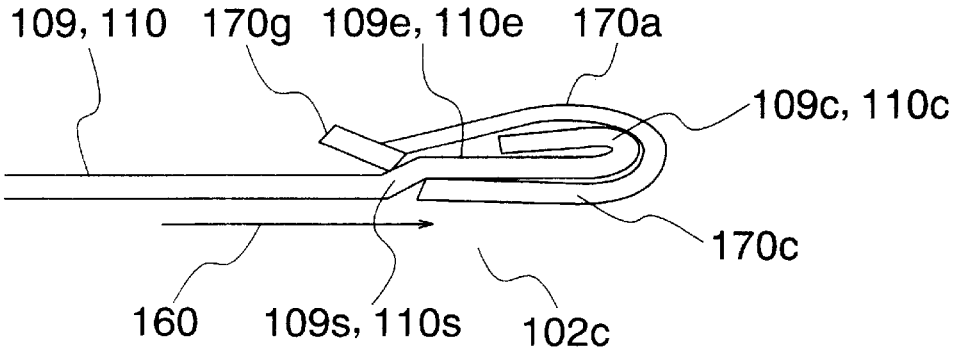
FIG. 17 shows cross-sectional view of the curled edge of the vane-wheel and the second variation of the balance weight in one embodiment of the present invention.
Figure 18:
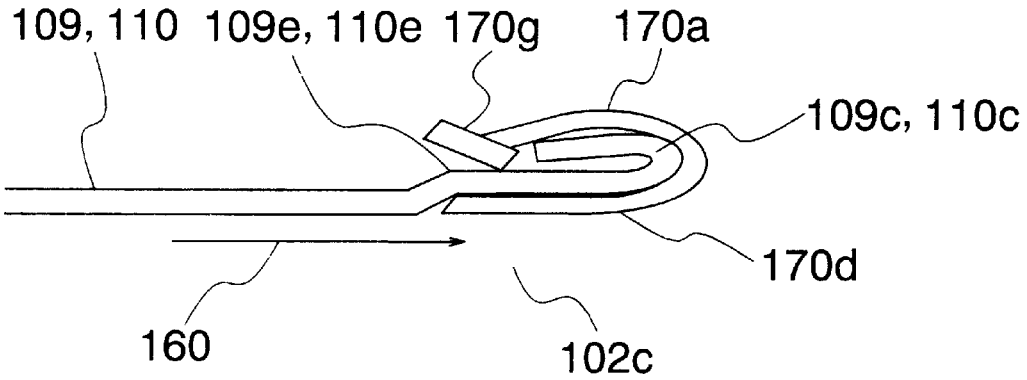
FIG. 18 shows cross-sectional view of the curled edge of the vane-wheel and the third variation of the balance weight in one embodiment of the present invention.

Variations of the balance weight 170 are explained referring to FIGS. 16–18. These variations are designed to prevent or to suppress a separation of the air flow 160 caused by turbulence 160*t* at the stopper 170*g*.

FIG. 16 shows a first variation of the balance weight 170. A recessed portion 109*d* or 110*d* is formed juxtaposed to the curled portion 109*a*, 110*a* in the radial direction, in such a manner that the recessed portion is disposed facing to the air flow path towards the blowing port 102*c*. The balance weight is also U-shaped and one of its arm 170*b* is extended straight and has a slightly inward curved portion at its end, while the other arm 170*a* has the stopper 170*g* similar to that disclosed in FIG. 15. When the balance weight 170 is attached to the flattened portion 109*c* or 110*c*, the arm 170*b* extends along the inner surface (the surface facing to the air flow 160) of the base plate 109 or the shroud 110. The slightly inward curved portion is locked within the recessed portion 109*d* or 110*d*, and the stopper 170*g* is locked by the flattened portion 109*c* or 110*c*. As disclosed in FIG. 16, the base plate 109 or the shroud 110 is squeezed by the stopper 170*g* and the arm 170*b*, and the air flow 160 can flow smoothly along the inner surface of the base plate 109 or the shroud 110 and along the outer surface of the arm 170*b*. Thus, separation is prevented.

The second variation is explained referring to FIG. 17. In this variation, the outer periphery of the base plate 109 or the shroud 110 is biased to the outer surface (the surface opposite to the air flow 160) approximately by the thickness of the balance weight 170. The balance weight 170 is also U-shaped and has an arm 170*c* just extending straight and the arm 170*a* having the stopper 170*g* at its end. When the balance weight 170 is attached to the flattened portion 109*c* or 110*c*, the arm 170*c* extends along the inner surface (the surface facing to the air flow 160) of the biased portion 109*e* or 110*e* of the base plate 109 or the shroud 110, and the stopper 170*g* is locked by the step portion 109*s*, 110*s* formed by the biased portion 109*e*, 110*e*. As disclosed in FIG. 17, the base plate 109 or the shroud 110 is squeezed by the stopper 170*g* and the arm 170*c*, and the air flow 160 can flow smoothly along the inner surface of the base plate 109 or the shroud 110 and along the outer surface of the arm 170*c*. Thus, separation is prevented.

The third variation is explained referring to FIG. 18. In this variation, the outer periphery of the base plate 109 or the shroud 110 is also biased to the outer surface (the surface opposite to the air flow 160) approximately by the thickness of the balance weight 170 similarly to the second variation. The balance weight 170 is also U-shaped and has an arm 170*c* just extending straight and the arm 170*a* having the stopper 170*g* at its end. When the balance weight 170 is attached to the flattened portion 109*c* or 110*c*, the arm 170*c* extends along the inner surface (the surface facing to the air flow 160) of the biased portion 109*e* or 110*e* of the base plate 109 or the shroud 110, and the stopper 170*g* is locked by the flattened portion 109*c*, 110*c*. As disclosed in FIG. 18, the base plate 109 or the shroud 110 is squeezed by the stopper 170*g* and the arm 170*c*, and the air flow 160 can flow smoothly along the inner surface of the base plate 109 or the shroud 110 and along the outer surface of the arm 170*c*. Thus, separation is prevented.

Since the constructions in these variations can prevent occurrence of separation, substantial improvement such as improvement of fan characteristics, and reduction of noise, can be attained.

Figure 19:
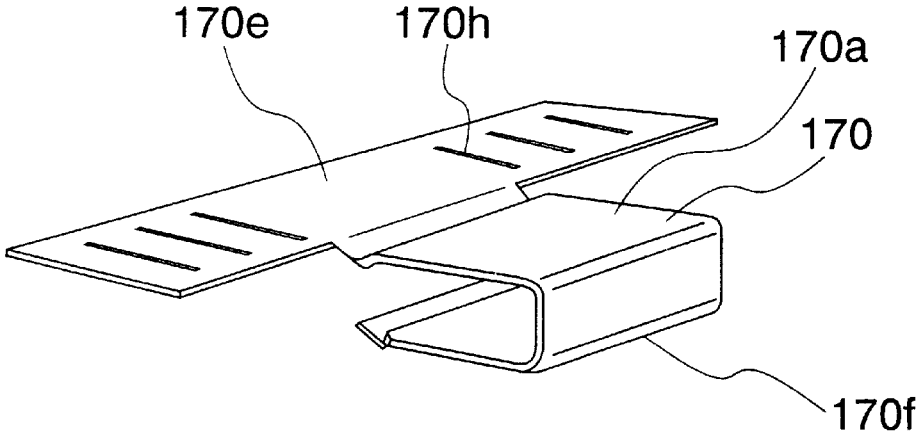
FIG. 19 shows a perspective view of the fourth variation of the balance weight in one embodiment of the present invention.
Figure 20:
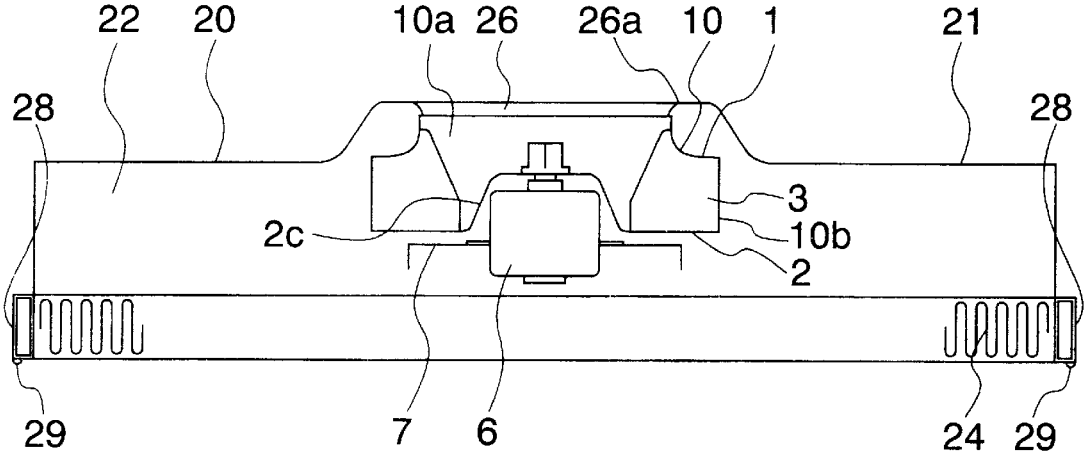
FIG. 20 shows a front view of an air cleaner in the related art.
Figure 21:
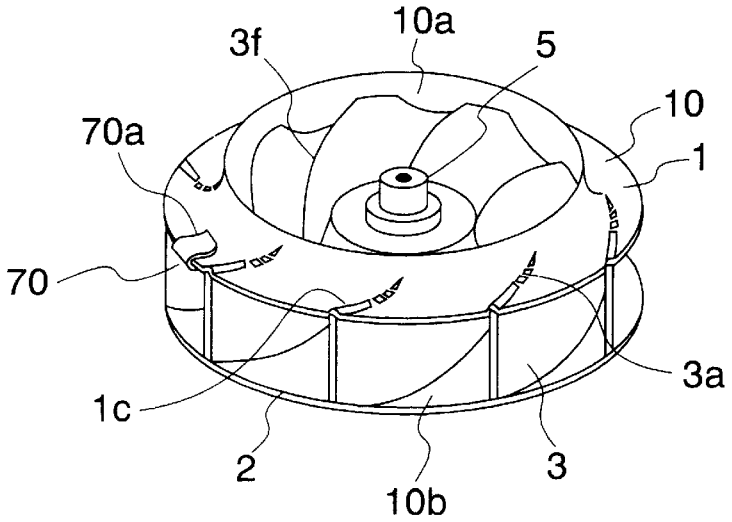
FIG. 21 shows a plan view of a vane-wheel of an air cleaner in the related art.
Figure 22:
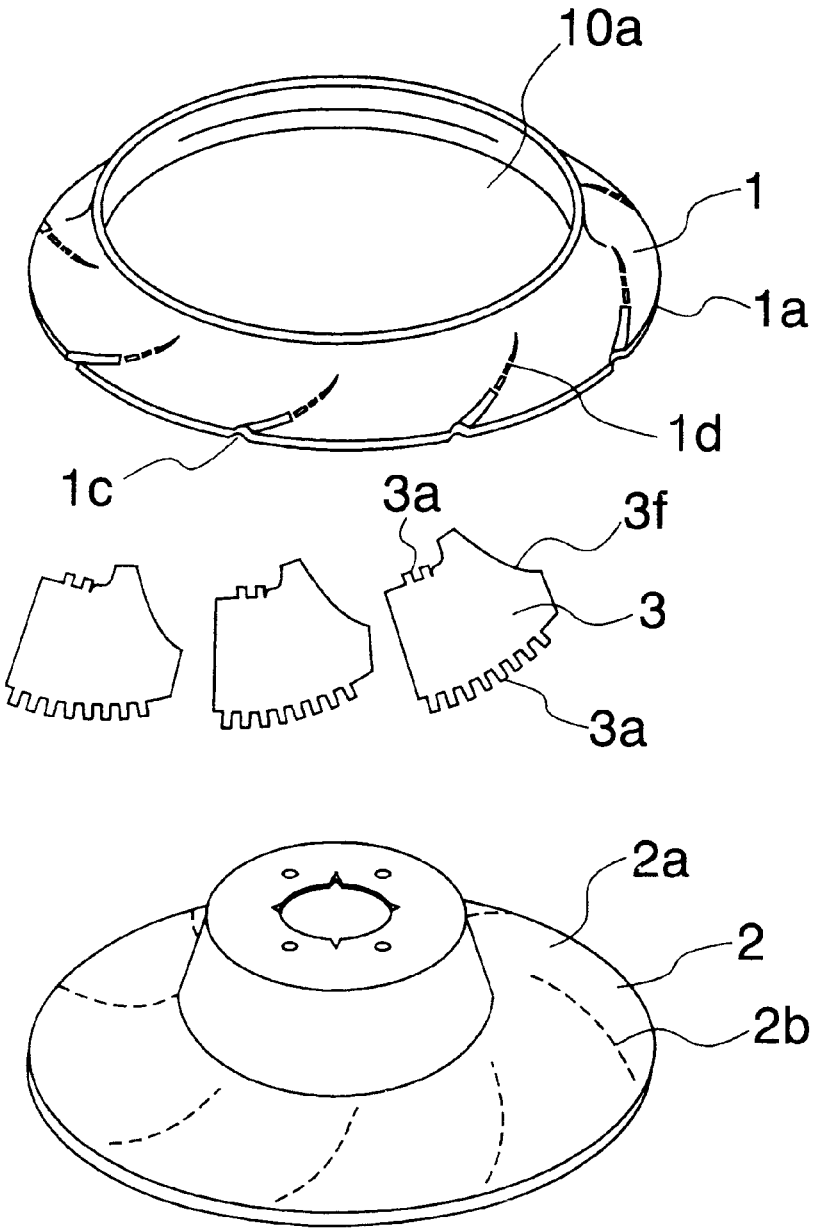
FIG. 22 shows a perspective exploded view of a vane-wheel in the related art.

The fourth variation of the balance weight is explained referring to FIG. 19. In this variation, the balance weight 170 has a mass-adjusting portion 170*e* at the end of one of the arms 170*a*. The mass of the balance weight can be varied by changing the size (the width or length) of the mass-adjusting portion 170*e*, with the width of the inserting portion 170*f* kept constant. Balance weights having different mass can be prepared by changing the size of the mass-adjusting portion 170*e*. Accurate balance adjusting is possible by attaching the balance weight having a suitable mass selectively. By preparing many kinds of balance weights, and attaching the suitable one to the flattened portion 109*c*, 110*c* selectively, rapid selection, rapid installing, rapid changing of the balance weight is attained. When preparing many kinds of balance weights is too costly, it is practical to prepare only one kind of balance weight having a mass-adjusting portion 170*e*, and to adjust the weight by cutting the width or length of the mass-adjusting portion 170*e*. In this case, disposing a notch 170*h*, which indicates a mass when the mass-adjusting portion is cut there, will be convenient to adjust the mass. The mass-adjusting portion 170*e* is disposed on the opposite side of the air flow path not to be an obstacle to the air flow. Cost reduction by standardization of parts is possible by this variation.

As for the materials for the vane-wheel 102 including the balance weight 170, such metal plates as aluminum plate with anticorrosive treatment, stainless plate, and steel plate with anticorrosive treatment can be employed. When the air cleaner in this embodiment is installed within a ceiling of a clean room, especially for manufacturing semiconductors therein where high level of cleanliness level is required, stainless steel plate is employed for preventing a corrosion by corrosive gas.

An air cleaner in this embodiment is installed on a lattice framework of 600 mm×1200 mm which is disposed on a ceiling of a clean room. An example of the specification of the air cleaner is as follows: as for each component, the motor 103 is an induction motor of a rated output of 26 W operated at 3 phase, 200V, 50 Hz; the turbo fan 130 is a combination of the motor 103 and the vane-wheel 102 with three winglike vanes 108 and having an outer periphery diameter D2s of 340 mm; the filter 105 has a maximum rated pressure loss of 10.5 mmAq (average pressure loss 9.5 mmAq) at rated air flow volume of 18.5 cubic meter/min. When the air cleaner is operated, according to a combination of characteristics of the turbo fan 130 and the filter 105, an air flow volume of 13 cubic meter/min. and an air flow average velocity of 0.3 m/sec. is provided at static pressure loss of 29.4 Pa (3 mmAq), as disclosed in FIG. 11. At this condition, a power consumption of the air cleaner is 40 W as disclosed in FIG. 11, and a noise level then is 43–42 dB. Since the values included in the specifications vary according to the variations of specification of each component, an allowed range of the variation for the air flow volume and the power consumption is deternimed within 10% of the rated value (90%–110% of the rated value).

This concludes the description of the preferred embodiments. Although the present invention has been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

What is claimed is:

1. An air cleaner, comprising;

a housing having an upper wall and side walls;

an air filter mounted with respect to said housing;

a fan including a vane-wheel having a base plate, a shroud and a plurality of vanes;

a supporting plate extending substantially between at least two side walls of said housing for supporting said fan; and at least one air flow directional member extending between said supporting plate and said upper wall, for directing an air flow output from said fan;

wherein said vane is formed to have a winglike cross-section, and said vane-wheel includes not more than four vanes.

2. An air cleaner according to claim 1, wherein each of said base plate and said shroud is formed to have a circular circumference, at least either one of said base plate and said shroud has a reinforcement portion at the circumference thereof.

3. An air cleaner according to claim 2, wherein said reinforcement portion has a curled portion, and said curled portion has a flattened portion where a U-shaped balance weight is attached.

4. An air cleaner according to claim 1, wherein said vane-wheel includes four vanes.

5. An air cleaner according to claim 1, wherein said vane-wheel includes three vanes.

6. An air cleaner according to claim 1, wherein said plurality of vanes are smooth-surfaced vanes.

7. An air cleaner according to claim 1, wherein said plurality of vanes each have a continuous smooth surface.

8. An air cleaner according to claim 1, wherein said vane has a front end arranged obliquely with respect to a rear end of said vane.

9. An air cleaner, comprising;

a housing having an upper wall and side walls;

an air filter mounted with respect to said housing;

a fan including a vane-wheel having a base plate, a shroud and a plurality of vanes;

a supporting plate extending substantially between at least two side walls of said housing for supporting said fan; and at least one air flow directional member extending between said supporting plate and said upper wall for directing an air flow output from said fan;

wherein each of said base plate and said shroud is formed to have a circular circumference, and at least either one of said base plate and said shroud has a reinforcement portion at a circumference thereof.

10. An air cleaner according to claim 9, wherein said reinforcement portion has a curled portion, and said curled portion has a flattened portion where a U-shaped balance weight is attached.

11. An air cleaner according to claim 9, wherein said vane-wheel includes four vanes.

12. An air cleaner according to claim 9, wherein said vane-wheel includes three vanes.

13. An air cleaner according to claim 9, wherein said plurality of vanes are smooth-surfaced vanes.

14. An air cleaner according to claim 9, wherein said plurality of vanes each have a continuous smooth surface.

15. An air cleaner according to claim 9, wherein each of said vanes is formed to have a winglike cross-section, and said vane-wheel includes not more than four vanes.

16. A fan unit adapted for use with an air cleaner, comprising;

a housing having an upper wall and side walls;

a fan including a vane-wheel having a base plate, a shroud and a plurality of vanes;

a supporting plate extending substantially between at least two side walls of said housing for supporting said fan; and at least one air flow directional member extending between said supporting plate and said upper wall for directing an air flow output from said fan;

wherein said vane is formed to have a winglike cross-section, and said vane-wheel includes not more than four vanes.

17. A fan unit according to claim 16, wherein said vane-wheel includes four vanes.

18. A fan unit according to claim 16, wherein said vane-wheel includes three vanes.

19. A fan unit according to claim 16, wherein said plurality of vanes are smooth-surfaced vanes.

20. A fan unit according to claim 16, wherein said plurality of vanes each have a continuous smooth surface.

21. A fan unit according to claim 16, wherein each of said base plate and said shroud is formed to have a circular circumference, and at least either one of said base plate and said shroud has a reinforcement portion at the circumference thereof.

22. A fan unit adapted for use with an air cleaner, comprising;

a housing having an upper wall and side walls;

a fan including a vane-wheel having a base plate, a shroud and a plurality of vanes;

a supporting plate extending substantially between at least two side walls of said housing for supporting said fan; and at least one air flow directional member extending between said supporting plate and said upper wall directing an air flow output from said fan;

wherein each of said base plate and said shroud is formed to have a circular circumference, and at least either one of said base plate and said shroud has a reinforcement portion at the circumference thereof.

23. A fan unit according to claim 22, wherein said vane-wheel includes four vanes.

24. A fan unit according to claim 22, wherein said vane-wheel includes three vanes.

25. A fan unit according to claim 22, wherein said plurality of vanes are smooth-surfaced vanes.

26. A fan unit according to claim 22, wherein said plurality of vanes each have a continuous smooth surface.

27. A fan unit adapted for use with an air cleaner, comprising;

a housing having an upper wall and side walls;

a fan including a vane-wheel having a base plate, a shroud and a plurality of vanes;

a supporting plate extending substantially between at least two side walls of said housing for supporting said fan; and at least one air flow directional member extending between said supporting plate and said upper wall directing an air flow output from said fan;

wherein said vane is formed to have a winglike cross-section, said vane-wheel includes not more than four vanes, each of said base plate and said shroud is formed to have a circular circumference, and at least either one of said base plate and said shroud has a reinforcement portion at the circumference thereof.

28. A fan unit according to claim 27, wherein;

said reinforcement portion has a curled portion, and said curled portion has a flattened portion where a U-shaped balance weight is attached.

29. A fan unit according to claim 27, wherein said vane-wheel includes four vanes.

30. A fan unit according to claim 27, wherein said vane-wheel includes three vanes.

31. A fan unit according to claim 27, wherein said plurality of vanes are smooth-surfaced vanes.

32. A fan unit according to claim 27, wherein said plurality of vanes each have a continuous smooth surface.

33. An air cleaner, comprising;

a housing having an upper wall and side walls;

a fan including a vane-wheel having a base plate, a shroud, a plurality of vanes and a motor for rotating said vane-wheel;

a supporting plate extending substantially between at least two side walls of said housing for supporting said fan;

at least one air flow directional member extending between said supporting plate and said upper wall for directing an air flow output from said fan; and an air filter mounted with respect to said housing for purifying air supplied from said fan;

wherein said vane is formed to have a winglike cross-section, said vane-wheel includes not more than four vanes, each of said base plate and said shroud is formed to have a circular circumference, at least either one of said base plate and said shroud has a reinforcement portion at the circumference thereof, and power consumption of said motor is within a range of 36–44 W when an air flow volume output from said air filter is within a range of 11.7–14.3 cubic meter/min.

34. An air cleaner according to claim 33, wherein said vane-wheel includes four vanes.

35. An air cleaner according to claim 33, wherein said vane-wheel includes three vanes.

36. An air cleaner according to claim 33, wherein said plurality of vanes are smooth-surfaced vanes.

37. An air cleaner according to claim 33, wherein said plurality of vanes each have a continuous smooth surface.

* * * * *